US005174852A

United States Patent [19]

Zepf

[11] Patent Number: 5,174,852

[45] Date of Patent: Dec. 29, 1992

[54] METHOD AND APPARATUS FOR ATTACHING LABELS TO CONTAINERS

[75] Inventor: Georg Zepf, Hagelstadt, Fed. Rep. of Germany

[73] Assignee: Krones AG Hermann Kronseder Maschinenfabrik, Neutraubling, Fed. Rep. of Germany

[21] Appl. No.: 830,565

[22] Filed: Feb. 4, 1992

[30] Foreign Application Priority Data

Feb. 22, 1991 [DE] Fed. Rep. of Germany ..... 4105524

[51] Int. Cl.[5] ..... B65C 9/00

[52] U.S. Cl. ..... 156/566; 156/567; 156/570; 156/571; 156/564

[58] Field of Search ..... 156/451, 452, 564, 566, 156/573, 567, 570, 571

[56] References Cited

U.S. PATENT DOCUMENTS

| | | | |
|---|---|---|---|
| 3,730,516 | 5/1973 | Debray | 156/451 X |
| 4,923,557 | 5/1990 | Dickey | 156/456 X |
| 5,078,826 | 1/1992 | Piogall | 156/451 |

FOREIGN PATENT DOCUMENTS

| | | |
|---|---|---|
| 2642046 | 3/1978 | Fed. Rep. of Germany . |
| 3041057 | 5/1982 | Fed. Rep. of Germany . |
| 8703630 | 6/1987 | Fed. Rep. of Germany . |

*Primary Examiner*—David A. Simmons
*Assistant Examiner*—James J. Engel
*Attorney, Agent, or Firm*—Finnegan, Henderson, Farabow, Garrett & Dunner

[57] ABSTRACT

In a method for attaching labels to containers, the labels are removed from a stack by rolling contact with an adhesive surface coated with a cold glue. Prior to termination of the removing step, a localized hot glue coating is in addition applied to the foremost label in the stack. After the label has thus been coated with cold glue and hot glue, it is peeled of the adhesive surface and pressed into contact of its glue-coated backside with a container. The provision that the hot glue coating is applied to the label while it is still held in the magazine ensures that the shape and position of the hot glue coating is fully independent of the speed of the labelling operation.

10 Claims, 1 Drawing Sheet

METHOD AND APPARATUS FOR ATTACHING LABELS TO CONTAINERS

DESCRIPTION

Figure 1:
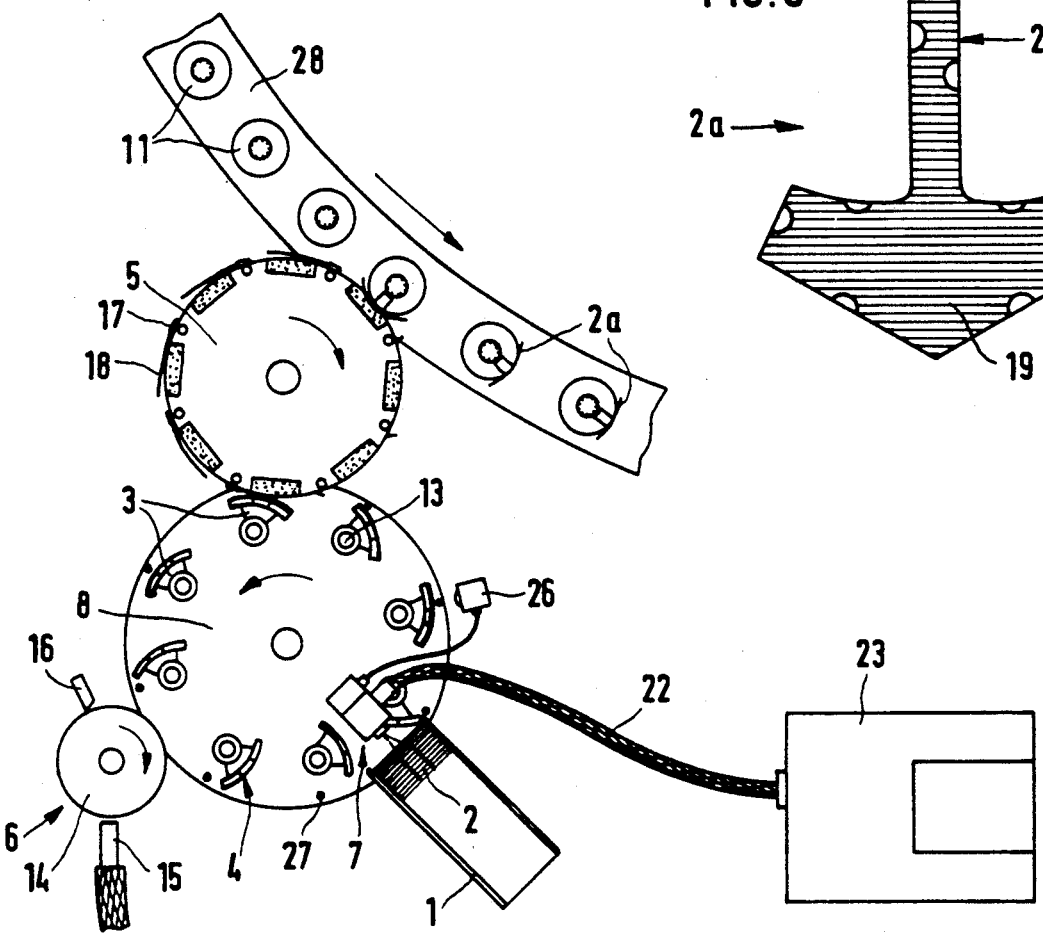

The invention relates to a method for attaching labels to containers according to the generic clause of claim 1, and to an apparatus for performing the method according to the generic clause of claim 7.

Already known are methods and apparatus of this type, in which the hot glue is applied to the previously cold glue-coated labels after release from the adhesive surface, either by means of spray nozzles disposed at fixed positions adjacent the periphery of a gripper cylinder (DE-OS 30 41 057), or by means of an applicator roller rotatably mounted adjacent the periphery of a gripper cylinder (DE-OS 26 42 046). The removal of the labels and their cold-glue coating process permits an accurate and unhampered removal of even intricately shaped labels with a high output. The additional dot- or strip-shaped hot glue application results in that the labels reliably adhere to materials, such as metal or plastics, which are insufficiently suitable for applications using cold (or "wet") glue. The labels may therefore be used as a warranty seal. On the other hand, in both of the cited cases the hot glue is applied to the labels while they are in motion, resulting in difficulties regarding the accurate location and area definition of the hot glue application. This makes itself particularly felt in the case of high outputs and corresponding conveying speeds.

There is already also known a method and apparatus for its performance of a completely different type, in which the removals of the labels from a staionary magazine is not accomplished by means of adhesive surfaces having a large area coated with cold or wet glue, but rather directly by the container to be labelled, which to this purpose is provided with a narrow hot flue strip extending along a generatrix (DE-GM 87 03 630). For bonding the overlap of the leading and trailing ends of the label on the container, the trailing end of the foremost label in the magazine is in each case provided with a row of hot glue dots by means of a series of stationary applicator nozzles. This known method is only suitable for applying simple wrapper labels to cylindrical containers, and that only with a relatively low output. The method does not permit the application of more intricately shaped labels to containers of non-cylindrical shape, particularly with the purpose to act as a warranty seal.

It is an object of the invention to improve a method and apparatus of the type defined above so as to reduce the dependency of the accuracy of the hot glue application on the speed and output of the labelling operation.

This object is attained according to the invention by the characteristics of claim 1 as regards the method, and by the characteristics of claim 7 as regards the apparatus.

According to the method of the invention, and in the apparatus according to the invention, the hot glue is applied while the respective label is still completely or partially retained on the stack or in the magazine, respectively, when the cold-glue coating operation has not yet begun or is just in progress. In this manner, all the problems resulting from the hot glue applications to moving labels are immediately avoided. The shape and position of the hot glue application can be accurately determined and maintained constant. Even the operation with varying output performance, as customary in the case of modern labelling machinery, does not result in any variation of the hot glue application. Due to the separation of areas coated with cold glue and hot glue, mutual impairment of the adhesive strengths and malfunctions in the release of the labels from the adhesive surfaces are fully avoided.

Advantageous improvements of the method according to the invention are set forth in claims 2 to 6, and of the apparatus according to the invention, in claims 8 to 10.

The method according to the invention and the apparatus according to the invention ensure a constant quality of the hot glue application under all operational conditions. The apparatus according to the invention may moreover be of a relatively simple construction, since the control of the hot glue applicator is independent of the moving speed of the adhesive surfaces or the gripper cylinder, respectively; it is therefore not required to provide variable derivative action timing for the activation of the applicator. Moreover there occurs no "trailing" of the hot glue coating which might otherwise be caused by a displacement of the applicator device and the label surface relative to one another.

Figure 3:
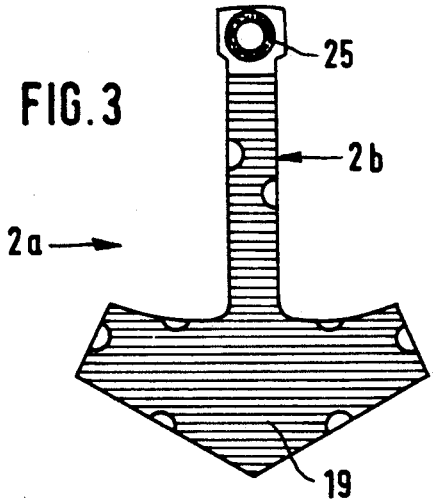
Figure 2:
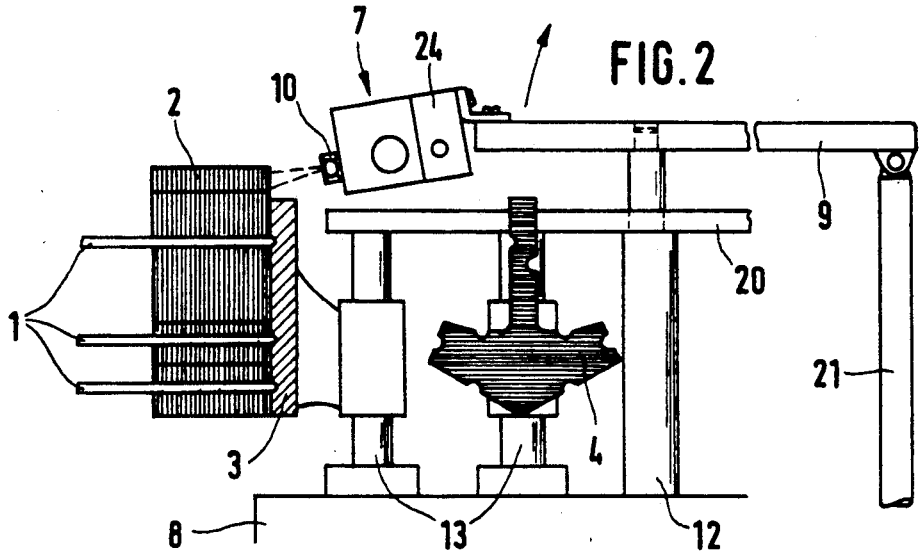

An embodiment of the invention shall now be described by way of example with reference to the drawings, wherein:

FIG. 1 shows a diagrammatic top plan view of an apparatus for attaching labels to bottles, with the bridge omitted, FIG. 2 shows a partial sideview of the apparatus of FIG. 1 with a remover element depicted in section, and FIG. 3 shows the backside of a glue-coated label shortly prior to its being attached to a bottle.

The apparatus of FIGS. 1 and 2 is integrated in an only partially shown labelling machine and serves for attaching anchor-shaped labels 2 to bottles 11 having a metal closure cap, e.g. a screw cap, so that label 2 acts as a warranty seal.

The apparatus comprises a rotor 8 mounted for continuous rotation about a vertical axis 12 and having eight shafts 13 rotatably mounted adjacent its periphery in parallel to axis 12. The lower ends of shafts 13 are operatively connected to a not shown cam transmission housed within rotor 8 and acting to impart oscillating movements to shafts 13 in response to the rotation of rotor 8. The upper ends of shafts 13 are mounted in a removable cover plate 20. Secured to each shaft 13 is a respective remover element 3 formed with a part-cylindrical adhesive surface 4 at a position excentrically offset from the axis of the respective shaft 13.

Provided adjacent the periphery of rotor 8 is a cold or wet glue applicator device 6 comprising a glue roller 14 mounted for continuous rotation in the direction of the arrow shown, a glue nozzle 15 and an adjustable doctor blade 16. On passing glue roller 14, remover elements 3 are controlled in such a manner that their finely grooved adhesive surfaces 4 come into substantially slip-free contact with the circumferential surface of glue roller 14 to thereby receive a uniform coating of the cold glue supplied by nozzle 15 and metered by doctor blade 16.

Also disposed at a fixed position adjacent the periphery of rotor 8 is a magazine 1, composed of a plurality of parallel guide rods, and adapted to contain a stack of labels 2 in such a manner that the foremost label 2 in the stack exposed at the removal opening of magazine 1 extends at a tangent to rotor 8. The ends of the guide rods defining the removal opening are provided with small projections (not shown) acting to retain labels 2 in magazine 1 as the stack is subjected at its rear end to the action of a likewise not shown pusher member. On passing magazine 1, remover elements 3 are controlled in such a manner that their adhesive surfaces 4, previously coated with a strip-shaped cold glue pattern, come into substantially slip-free contact with the foremost label 2 in the stack to thereby gradually remove it from the label stack and thus from magazine 1, by the adhesive action of their glue coating.

Finally, a gripper cylinder 5 equipped with cam-controlled gripping fingers 17 and resilient pressure pads 18 is mounted adjacent the periphery of rotor 8 for continuous rotation in the direction of the arrow shown. On passing gripper cylinder 5, remover elements 3 are controlled in such a manner that the leading ends of labels 2 are gripped by gripping fingers 17 and the labels are subsequently peeled off adhesive surfaces 4 in a careful manner. During these operations, part of the cold glue on adhesive surfaces 4 is transferred to the backside of the respective labels 2 so as to form a strip-shaped cold glue pattern 19 thereon as indicated by horizontal lines in FIG. 3.

As illustrated in FIGS. 2 and 3, adhesive surfaces 4 are provided with cutouts at locations corresponding to those of the guide rods of magazine 1 and gripping fingers 17 of gripper cylinder 5, these cutouts resulting in the formation of respective glue-free areas on the backsides of labels 2. In addition, the upper narrow portion of each remover element 3 corresponding to the strip-shaped top portion **2*b* of the labels 2 is somewhat shortened relative thereto, or the upper portion of adhesive surface 4 is completely omitted. The upper free end portion of the strip-shaped neck portion 2*b* of each label does thus not come into contact with remover element 3** on removal from the label stack, so that it remains free of cold glue.

Disposed above cover plate 20 in the normal operation of the apparatus is a plate-shaped bridge 9 having one of its ends pivotally connected to a vertical support bar 21 and releasably and rotatably support at its intermediate portion on center axis 12 of rotor 8 by means of a plug and socket connection. In the case of malfunction, or for a conversion of the apparatus requiring replacement of shafts 13 with remover elements 3 after cover plate 20 has been taken off, bridge 9 can be pivoted upwards to a substantially vertical position as indicated by the arrow in FIG. 2.

Secured to the other end portion of bridge 9 adjacent magazine 1 is a hot glue applicator device 7 comprising a glue nozzle 10 accurately directed onto the upper end portion of the strip-shaped neck portion **2*b* of the foremost label 2 in magazine 1. A heatable hose 22 is provided in the usual manner for connecting applicator device 7 to a glue supply assembly 23 comprising a heatable supply reservoir, a pressure pump, control components and the like and operable to supply liquid hot glue to applicator device 7. The latter further includes a solenoid valve 24 acting to admit the pressurized hot glue to glue nozzle 10 in successive pulses, so that the latter applies an annular bead-shaped hot glue coating 25 to the upper end portion of neck portion 2*b* of successive labels 2. At the location of hot glue coating 25** the label is free of cold glue.

Solenoid valve 24 of applicator device 7 is connected to and controlled by a sensor 26 acting to detect control pins 27 provided on the periphery of rotor 8 in association with each shaft 13. Sensor 26 is located so as to cause glue nozzle 10 to be activated for a short interval whenever one of adhesive surfaces 4 comes into contact with the trailing end of the foremost label 2 in magazine 1 (cf. FIG. 1). The application of glue coating 25 is terminated when the bar-shaped center portion of adhesive surface 4 comes into contact with neck portion **2*b* of label 2 and starts to remove it from magazine 1. The hot glue coating 25 is thus applied to an absolutely stable or stationary portion of label 2**, independent of the operating speed of the labelling machine.

Advantageously solenoid valve 24 is additionally controlled by a (not shown) bottle detector acting to prevent the removal of a label in the absence of a respective bottle. In this case, the hot glue application process is activated only when a bottle is available for a respective label, in other words, it is avoided that a label which is not as yet to be removed receives more than one hot glue coatings. The removal of labels may be prevented either by intermittent retraction of magazine 1 away from rotor 8, or by suitably controlling the movements of remover elements 3.

The labels 2 retained on the periphery of gripper cylinder 5 by its gripping fingers 17 thus have their outwards facing backsides provided with an annular hot glue coating 25 at their uppermost end portions, and a cold glue coating 19 in the form of horizontal stripes at their central and lower portions as illustrated in FIG. 3. For reducing the consumption of cold glue, coating 19 may be formed with additional void areas. The hot glue coating may also be of different shape, for instance in the form of a dot.

After the labels 2 have thus been coated with cold glue by adhesive surfaces 4, and with hot glue by means of glue nozzle 10, removed from the stack in magazine 1, and subsequently peeled off adhesive surfaces 4 in the manner described above, gripper cylinder 5 acts to apply them to bottles 11 carried on a bottle table 28 rotating in the direction of the arrow shown in FIG. 1, and to bring them into intimate contact with the body, neck and closure element of the bottles with the aid of resilient pressure pads 18 and an arrangement of blow nozzles (not shown). Thereafter, cold glue coating 19 ensures good adherence to the glass, and hot glue coating 25, to the metal of the bottle closure element. The label is finally pressed into conformity with the contours of bottle 11 by means of brush and/or sponge rollers (not shown). After the hot glue has been permitted to cool down, and the cold glue to dry, the opening of the bottle closure element inavoidably results in the strip-shaped neck portion **2*b* of label 2** being torn, so that the desired warranty seal effect is obtained in this manner.

I claim:

1. A method for attaching labels to containers, wherein the labels are supplied in the form of a stack, the foremost label in the stack is removed therefrom by rolling contact with a cold-glue-coated adhesive surface and at the same time has its backside coated with cold glue, the label is removed from said adhesive surface and is then pressed into contact of its glue-coated backside with a container, and wherein prior to said pressing step a hot glue coating is applied to said backside at least at a defined location for improving the adhesive strength, characterized in that in each case said hot glue is applied to the foremost label in the stack prior to its being completely removed therefrom by said adhesive surface, and that the hot-glue-coated location is kept free of cold glue as the cold glue coating is being applied by said adhesive surface.

2. A method according to claim 1, characterized in that said hot glue is applied while said adhesive surface is in rolling contact with said label.

3. A method according to claim 1 or 2, characterized in that said hot glue coating is applied by a pulsed spraying operation.

4. A method according to any of claims 1, characterized in that said hot glue is applied to the back of said label only at the location to be brought into contact with the container's closure.

5. A method according to claim 4, characterized in that said hot glue is applied to the back of said label at only a single location adjacent the end of a strip-shaped portion of the label.

6. A method according to any of claims 1, characterized in that said hot glue is applied to the back of said label in a substantially circular or annular configuration.

7. Apparatus for attaching labels to containers, comprising a magazine (1) for containing a stack of labels (2), at least one remover element (3) having a curved adhesive surface (4) adapted to be brought into rolling contact with said stack of labels, a gripper cylinder (5) operable to take said labels off said remover element and to press them into contact with the containers, an applicator device (6) adapted to have cold glue supplied thereto for applying it to said adhesive surface, and a hot glue applicator device (7), characterized in that said hot glue applicator device (7) is associated to said magazine (1) so as to act on each foremost label in said stack, that said adhesive surface (4) is recessed or omitted at the location of the label destined for the hot glue application, and that said hot glue applicator device (7) is controllable in accordance with the position of said adhesive surface (4) relative to said magazine (1).

8. Apparatus according to claim 7, characterized in that said hot glue applicator device (7) comprises at least one pulse-controlled glue spray nozzle (10) disposed at a constant distance opposite the removal opening of said magazine (1).

9. Apparatus according to claim 8, characterized in that said remover element (3) is carried by a rotor (8) for controlledly travelling along a closed path, and that said glue nozzle (10) of said applicator device (7) is located at a small distance adjacent the closed path of said remover elements (3).

10. Apparatus according to claim 9, characterized in that said glue nozzle (10) of said applicator device (7) is mounted on a bridge (9) adapted to be pivoted away from the closed path of said remover elements (3) and from said magazine (1).

* * * * *